US008757746B2

(12) United States Patent
Wing et al.

(10) Patent No.: US 8,757,746 B2
(45) Date of Patent: Jun. 24, 2014

(54) PRINTHEAD POSITIONING FOR WEB GAP ADJUSTMENT

(75) Inventors: Joseph M. Wing, Ontario, NY (US); Lauren E. Murphy, Phillipsburg, PA (US); Ling Ouyang, Rochester, NY (US); Matthew D. Savoy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 211 days.

(21) Appl. No.: 13/427,372

(22) Filed: Mar. 22, 2012

(65) Prior Publication Data

US 2013/0249979 A1 Sep. 26, 2013

(51) Int. Cl.
*B41J 25/308* (2006.01)

(52) U.S. Cl.
USPC ..... 347/8

(58) Field of Classification Search
CPC ..... B41J 25/308; B41J 25/3088
See application file for complete search history.

(56) References Cited

U.S. PATENT DOCUMENTS

| | | | | |
|---|---|---|---|---|
| 4,881,835 | A | 11/1989 | Niikawa | |
| 4,990,004 | A | 2/1991 | Kawahara et al. | |
| 5,074,685 | A | 12/1991 | Shimizu et al. | |
| 5,131,765 | A | 7/1992 | Bradley et al. | |
| 5,570,959 | A | 11/1996 | Moriwaki et al. | |
| 6,059,392 | A | 5/2000 | Park | |
| 6,406,110 | B1 | 6/2002 | Ahne et al. | |
| 6,497,466 | B1 | 12/2002 | Writt | |
| 6,736,557 | B2 * | 5/2004 | DeVore et al. | 400/59 |
| 6,851,777 | B2 | 2/2005 | Speckhart | |
| 7,292,796 | B2 | 11/2007 | Yax | |
| 2004/0047665 | A1 | 3/2004 | DeVore et al. | |
| 2004/0100512 | A1 * | 5/2004 | Codos | 347/8 |
| 2004/0119764 | A1 | 6/2004 | Speckhart | |
| 2007/0048057 | A1 | 3/2007 | Youn et al. | |

* cited by examiner

*Primary Examiner* — Matthew Luu
*Assistant Examiner* — Tracey McMillion
(74) *Attorney, Agent, or Firm* — Maginot, Moore & Beck, LLP

(57) ABSTRACT

An inkjet printer includes a printhead module having a plurality of printheads which eject ink for printing images on the surface of a recording media supported by a backing member. A gap distance between the printheads and the surface of the recording media is adjusted by a positioner coupled to the printhead module where a sensor determines the gap distance between the printhead module and the backing member.

14 Claims, 7 Drawing Sheets

PRINTHEAD POSITIONING FOR WEB GAP ADJUSTMENT

TECHNICAL FIELD

This disclosure relates generally to printhead positioning in an inkjet printer having one or more printheads, and more particularly, to adjustment of a gap between a printhead module and an imaging surface in an inkjet printer.

BACKGROUND

Inkjet printers operate a plurality of inkjets in each printhead to eject liquid ink onto an image receiving member. The ink may be stored in reservoirs that are located within cartridges installed in the printer. Such ink may be aqueous ink or an ink emulsion. Other inkjet printers receive ink in a solid form and then melt the solid ink to generate liquid ink for ejection onto the imaging member. In these solid ink printers, the solid ink may be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving member, the ink returns to a solid, but malleable form, in the case of melted solid ink, and to gelatinous state, in the case of gel ink.

A typical inkjet printer uses one or more printheads with each printhead containing an array of individual nozzles through which drops of ink are ejected by inkjets across an open gap to an image receiving surface to form an ink image during printing. The image receiving surface may be the surface of a continuous web of recording media, a series of media sheets, or the image receiving surface may be a rotating surface, such as the surface of a rotating print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that must be operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

In order for the printed images to correspond closely to the image data, both in terms of fidelity to the image objects and the colors represented by the image data, the printheads are registered with reference to the image receiving surface and with the other printheads in the printer. Registration of printheads refers to a process in which the printheads are operated to eject ink in a known pattern and then the printed image of the ejected ink is analyzed to determine the relative positions of the printheads with reference to the imaging surface and with reference to the other printheads in the printer. Operating the printheads in a printer to eject ink in correspondence with image data presumes that the printheads are level with one another across a width of the image receiving member and that all of the inkjets in the printhead are operational. The presumptions regarding the positions of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

Two or more printheads can be mounted linearly, or in other configurations, to a support structure, to form an array of printheads. Not only is registration between individual printheads important, but control of the registration of the supporting structure with respect to the image receiving surface is also desirable. The gap, or distance between support structure and the imaging surface, is controlled to optimize the imaging process. If the gap is too small, burnishing of the printheads can occur when the image receiving surface contacts the face of the printheads. Burnishing not only reduces the life of the printheads, but results in poor image quality and increased downtime of the printer during maintenance. If the gap it too large, image quality suffers, particularly in high speed printers, where a large gap can result in the ink drops being deposited at unintended locations.

The setting of a proper gap is important where a printer is designed to accept a variety of imaging surfaces, including surfaces having a tendency to wrinkle, having different thicknesses, or having uneven surfaces. Likewise, where a printer is used in an industry, such as advertising, where paper types and thickness can change from print job to print job, the capability of setting the gap between print jobs can be particularly important. In some instances, the location of the printer and its surrounding environment or the use of different types of inks necessitates setting the gap accordingly. Consequently, detecting the gap distance of the printhead array from the imaging surface and adjusting the gap distance appropriately are important considerations for image quality and printer operation.

SUMMARY

A printer includes a controller and a gap sensor to detect a gap between a positionable printhead module and a backup roll and to move the printhead module automatically to adjust the gap. The printer includes a media transport, mounted to a first frame and configured to transport a recording media through the printer in a process direction. A printhead module, operatively connected to a second frame, is disposed adjacent to the media transport wherein the printhead module supports a plurality of printheads configured to print onto the transported recording media. At least one positioner is operatively connected to the printhead module to adjust a gap distance between the printhead module and the media transport. At least one sensor, operatively connected to the printhead module, senses the gap distance and generates a signal representative of the gap distance. A controller is operatively connected to the sensor and to the at least one positioner. The controller receives the signal and sends an adjust signal to the at least one positioner to move the printhead module with respect to the media transport.

A printer includes a positionable printhead module located opposite a media transport, a sensor to determine a web gap between the printhead module and the media transport, and a motor to move the printhead module to adjust the web gap. The printer includes a media transport configured to transport a recording media through the printer in a process direction. A printhead module is disposed adjacent the media transport wherein the printhead module supports a plurality of printheads configured to print onto the transported recording media. At least one sensor is operatively connected to the printhead module and generates a signal representative of a gap distance between the printhead module and the media transport. A positioner is operatively connected to the printhead module and is adapted to receive the signal to move the printhead module with respect to the media transport to adjust the gap distance therebetween.

BRIEF DESCRIPTION OF THE DRAWINGS

The foregoing aspects and other features of a printer having a positionable printhead module to adjust a printhead to web gap are explained in the following description, taken in connection with the accompanying drawings.

DETAILED DESCRIPTION

Figure 1:
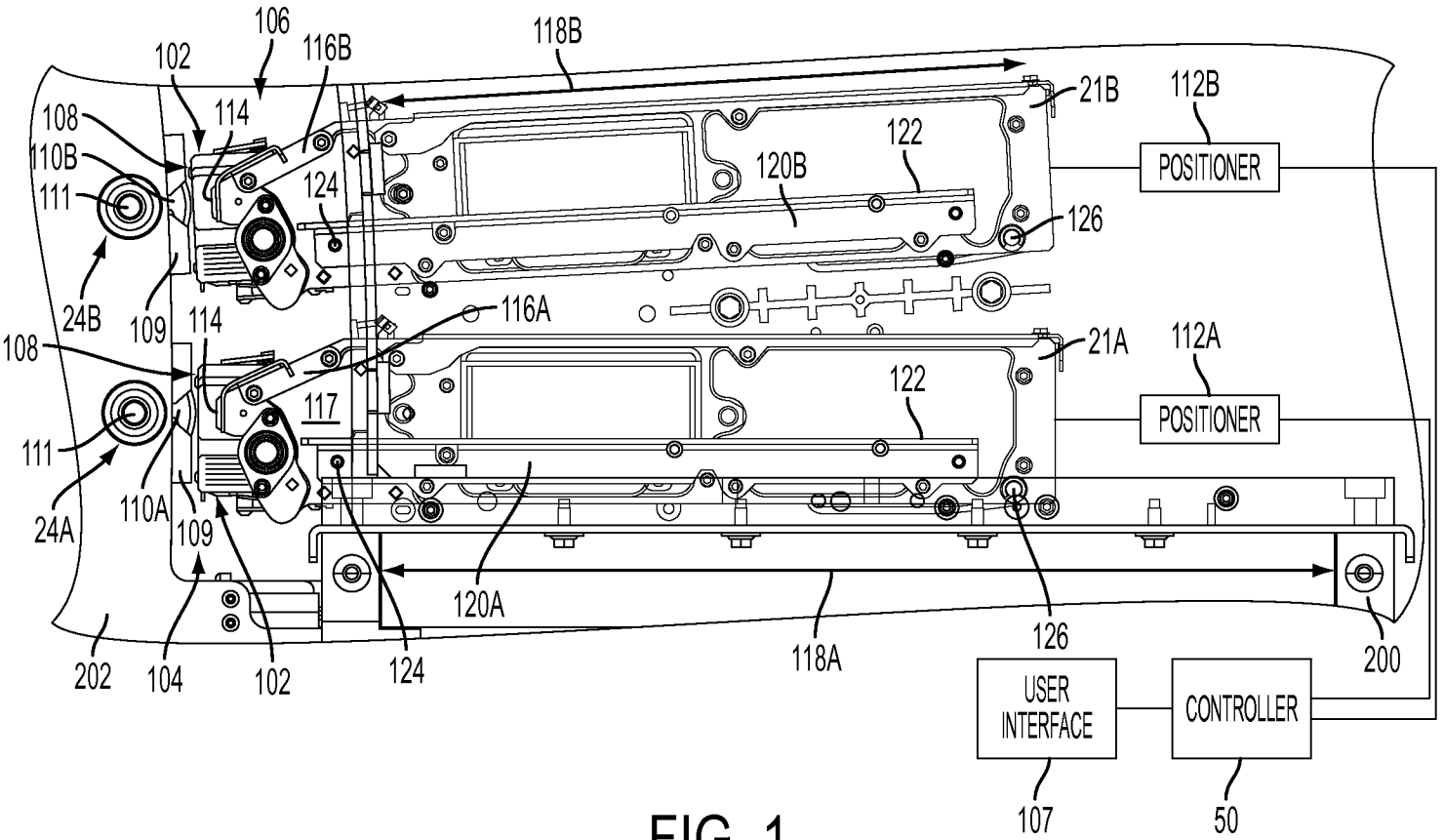
FIG. 1 is a side elevational view of a plurality of printhead modules each respectively positioned adjacently to a backing member.

For a general understanding of the environment for the system and method disclosed herein as well as the details for the system and method, reference is made to the drawings. In the drawings, like reference numerals have been used throughout to designate like elements. As used herein the term "printer" refers to any device that is configured to form ink images on media and includes, but is not limited to, photocopiers, facsimile machines, multifunction devices, as well as direct and indirect inkjet printers. An image receiving surface refers to any surface that receives ink drops, such as an imaging drum, imaging belt, or various print media including paper.

As used in this document, "ink" refers to a colorant that is liquid when applied to an image receiving member. For example, ink can be aqueous ink, ink emulsions, solvent based inks and phase change inks. "Phase change ink" refers to inks that are in a solid or gelatinous state at room temperature and change to a liquid state when heated to an operating temperature for application or ejection onto the image receiving member. The phase change inks return to a solid or gelatinous state when cooled on the print media after the printing process.

The term "printhead" as used herein refers to a component in the printer that is configured to eject ink drops onto the image receiving member. A typical printhead includes a plurality of inkjets that are configured to eject ink drops of one or more ink colors onto the print media. The inkjets are arranged in an array of one or more rows and columns. In some embodiments, the inkjets are arranged in staggered diagonal rows across a face of the printhead. Various printer embodiments include one or more printheads that form ink images on the print media.

Figure 7:
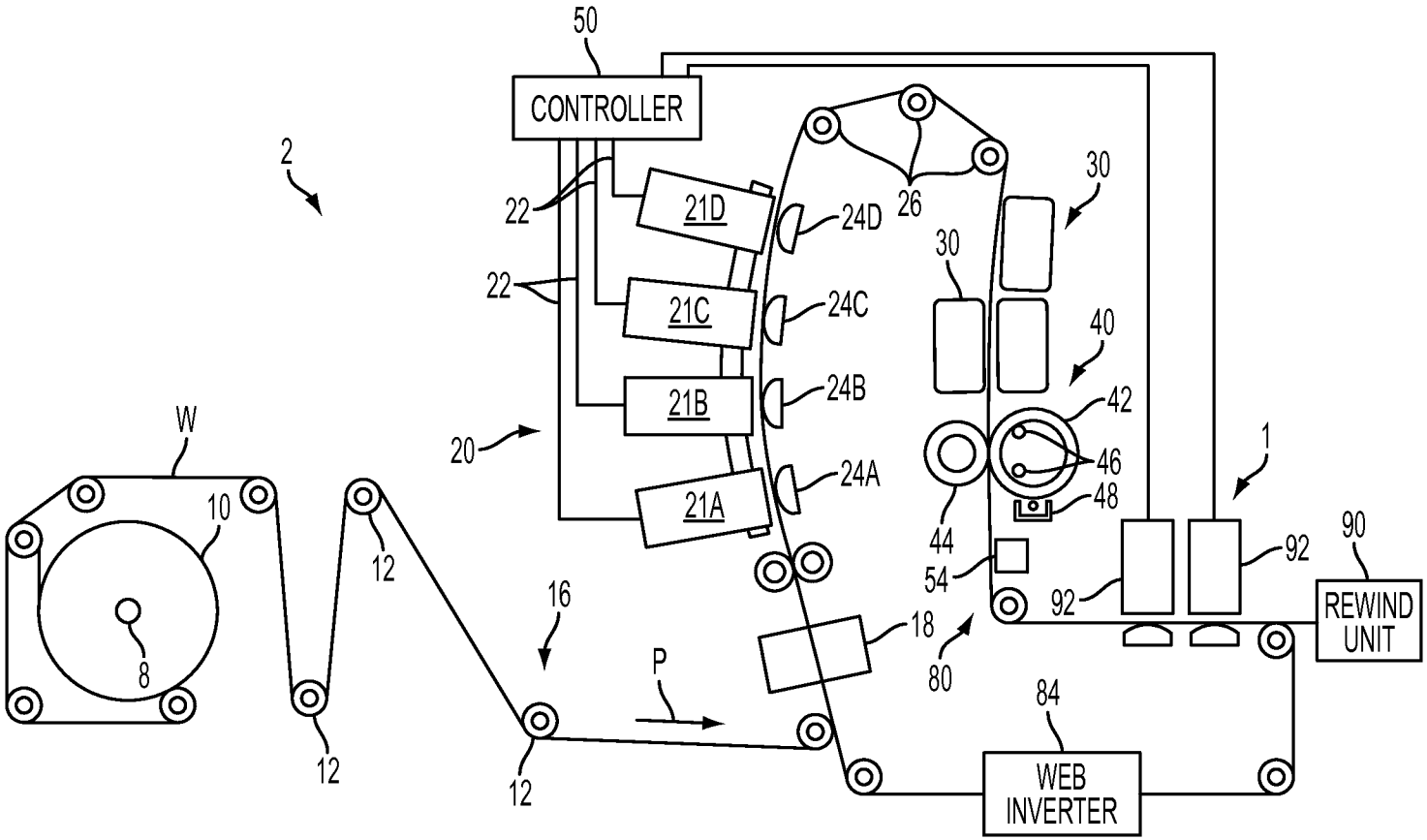
FIG. 7 PRIOR ART
FIG. 7 is a schematic view of a prior art inkjet imaging system that ejects ink onto a continuous web of media as the media moves past the printheads in the system.

FIG. 7 is a prior art inkjet printer that ejects ink onto a continuous web of media as the media moves past the printheads in the system. An embodiment of a printer, such as a high-speed phase change ink printer 2 in which the method and apparatus for printhead gap adjustment can be used, is depicted. For the purposes of this disclosure, the inkjet printer 2 of FIG. 7 employs one or more inkjet printheads and an associated solid ink supply. The imaging apparatus includes a print engine to process the image data before generating the control signals for the inkjet ejectors. The colorant can be ink, or any suitable substance that includes one or more dyes or pigments that can be applied to the selected media. The colorant can be black, or any other desired color, and a given imaging apparatus can be capable of applying a plurality of distinct colorants to the media.

FIG. 7 is a simplified schematic view of a direct-to-sheet, continuous-media, phase-change inkjet printer 2, that can be modified to include the method and apparatus for printhead gap adjustment. A media supply and handling system is configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 1, and rewind unit 90. For duplex operations, a web inverter 84 is used to flip the web over to present a second side of the media to the printing station 20, printed web conditioner 80, and coating station 1 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 1 before being flipped by the inverter 84 and laterally displaced by a distance that enables the web to travel over the other half of the rollers opposite the printing station 20, printed web conditioner 80, and coating station 1 for the printing, conditioning, and coating, if necessary, of the reverse side of the web. The rewind unit 90 is configured to wind the web onto a roller for removal from the printer and subsequent processing.

The media can be unwound from the source 10 as needed and propelled by a variety of motors (not shown) rotating one or more rollers. The media conditioner includes rollers 12 and a pre-heater 18. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The preheater 18 can use contact, radiant, conductive, or convective heat to bring the media to a target preheat temperature, which in one practical embodiment, is in a range of about 30 degrees C. to about 70 degrees C.

The media is transported through a printing station 20 that includes a series of printhead modules, which are sometimes known as print box units, 21A, 21B, 21C, and 21D, each printhead module effectively extending across the width of the media and being able to place ink directly (i.e., without use of an intermediate or offset member) onto the moving media. A printhead module can include one or more printheads operatively connected to a frame and aligned thereon for depositing ink to form an image. The printhead module can include associated electronics, ink reservoirs, and ink conduits to supply ink to the one or more printheads. Any one, some, or all of the printhead modules 21A-21D can be angled with respect to horizontal. As is generally familiar, each of the printheads of the printhead array can eject a single color of ink, one for each of the colors typically used in color printing, namely, cyan, magenta, yellow, and black (CMYK).

The controller 50 of the printer receives velocity data from encoders mounted proximately to rollers positioned on either side of the portion of the path opposite the four printheads to compute the position of the web as it moves past the printheads. The controller 50 uses these data to generate timing signals for actuating the inkjet ejectors in the printheads to enable the four colors to be ejected with a reliable degree of accuracy for registration of the different color patterns to form four primary-color images on the media. The inkjet ejectors actuated by the firing signals corresponds to image data processed by the controller 50. The image data can be transmitted to the printer, generated by a scanner (not shown) that is a component of the printer, or otherwise generated and delivered to the printer. In various possible embodiments, a printhead module for each primary color can include one or more printheads; multiple printheads in a module can be formed into a single row or multiple row array; printheads of a multiple row array can be staggered; a printhead can print more than one color; or the printheads or portions thereof can be mounted movably in a direction transverse to the process direction P, such as for spot-color applications and the like.

The printer 2 uses "phase-change ink" as that term has been previously defined above. Associated with each printhead module is a backing member 24A-24D, typically in the form of a bar or roll, which is arranged substantially opposite the printhead on the back side of the media. Each backing member is used to position the media in front of the printhead opposite the backing member. Each backing member can be configured to emit thermal energy to heat the media to a predetermined temperature which, in one practical embodiment, is in a range of about 40 degrees C. to about 60 degrees C. The various backer members can be controlled individually or collectively as part of the media transport. The preheater 18, the printheads, backing members 24 (if heated), as well as the surrounding air, combine to maintain the media along the portion of the path opposite the printing station 20 in a predetermined temperature range of about 40 degrees C. to 70 degrees C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore, other temperature regulating devices can be employed to maintain the media temperature within a predetermined range. For example, the air temperature and air flow rate behind and in front of the media can also impact the media temperature. Accordingly, air blowers or fans can be utilized to facilitate control of the media temperature. Thus, the media temperature is kept substantially uniform for the jetting of all inks from the printheads of the printing station 20. Temperature sensors (not shown) can be positioned along this portion of the media path to enable regulation of the media temperature. Temperature data can also be used by systems for measuring or inferring (from the image data, for example) how much ink of a given primary color from a printhead is being applied to the media at a given time.

Following the printing zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35 degrees C. to about 80 degrees C. The mid-heater 30 has the effect of equalizing the ink and substrate temperatures to within about 15 degrees C. of each other. Lower ink temperature gives less line spread while higher ink temperature causes show-through (visibility of the image from the other side of the print). The mid-heater 30 adjusts substrate and ink temperatures to 0 degrees C. to 20 degrees C. above the temperature of the spreader.

Following the mid-heaters 30, a fixing assembly 40 is configured to apply heat and/or pressure to the media to fix the images to the media. The fixing assembly can include any suitable device or apparatus for fixing images to the media including heated or unheated pressure rollers, radiant heaters, heat lamps, and the like. In the embodiment of the FIG. 7, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 can also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35 degrees C. to about 80 degrees C. In alternative embodiments, the fixing assembly can be configured to spread the ink using non-contact heating (without pressure) of the media after the print zone. Such a non-contact fixing assembly can use any suitable type of heater to heat the media to a desired temperature, such as a radiant heater, UV heating lamps, and the like.

In one embodiment, the roller temperature in spreader 40 is maintained at a temperature to an optimum temperature that depends on the properties of the ink, such as 55 degrees C. Generally, a lower roller temperature gives less line spread while a higher temperature causes imperfections in the gloss. Roller temperatures that are too high can cause ink to offset to the roll. In one practical embodiment, the nip pressure is set in a range of about 500 to about 2000 psi lbs./side. Lower nip pressure gives less line spread while higher pressure can reduce pressure roller life.

The spreader 40 can also include a cleaning/oiling station 48 associated with image-side roller 42. The station 48 cleans and/or applies a layer of some release agent or other material to the roller surface. The release agent material can be an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment the media is maintained at a high temperature as it is printed to enable spreading of the ink.

The coating station 1 applies a clear ink to the printed media. This clear ink helps protect the printed media from smearing or other environmental degradation following removal from the printer. The overlay of clear ink acts as a sacrificial layer of ink that can be smeared and/or offset during handling without affecting the appearance of the image underneath. The coating station 1 can apply the clear ink with either a roller or a printhead 92 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating can be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink can be heated to about 100 degrees C. to 140 degrees C. to melt the solid ink for jetting onto the media.

Following passage through the spreader 40, the printed media can be wound onto a roller for removal from the system (simplex printing) or directed to the web inverter 84 for inversion and displacement to another section of the rollers for a second pass by the printheads, mid-heaters, spreader, and coating station. The duplex printed material can then be wound onto a roller for removal from the system by rewind unit 90. Alternatively, the media can be directed to other processing stations that perform tasks such as cutting, binding, collating, and/or stapling the media or the like.

Operation and control of the various subsystems, components and functions of the printer 2 are performed with the aid of the controller 50. The controller 50 can be implemented with general or specialized programmable processors that execute programmed instructions. The instructions and data required to perform the programmed functions can be stored in memory associated with the processors or controllers. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The printer 2 can also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system can be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment can include three linear arrays, one for each of the colors red, green, and blue. Alternatively, all of the LEDS can be arranged in a single linear array in a repeating sequence of the three colors. The LEDs of the light source can be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array can be configured to translate across the image substrate. For example, the linear array can be mounted to a movable carriage that translates across image receiving member. Other devices for moving the light sensor can also be used.

FIG. 1 is a side elevational view of printhead modules 21A and 21B positioned adjacently to respective backing members 24A and 24B. Each of the printhead modules 21A and 21B includes a plurality of printheads 102, two of which are illustrated, with each one being located at an end 104 of one of a respective printhead module 21. Additional printheads 102 can be included in the printhead module and are illustrated in FIG. 4.

Figure 4:
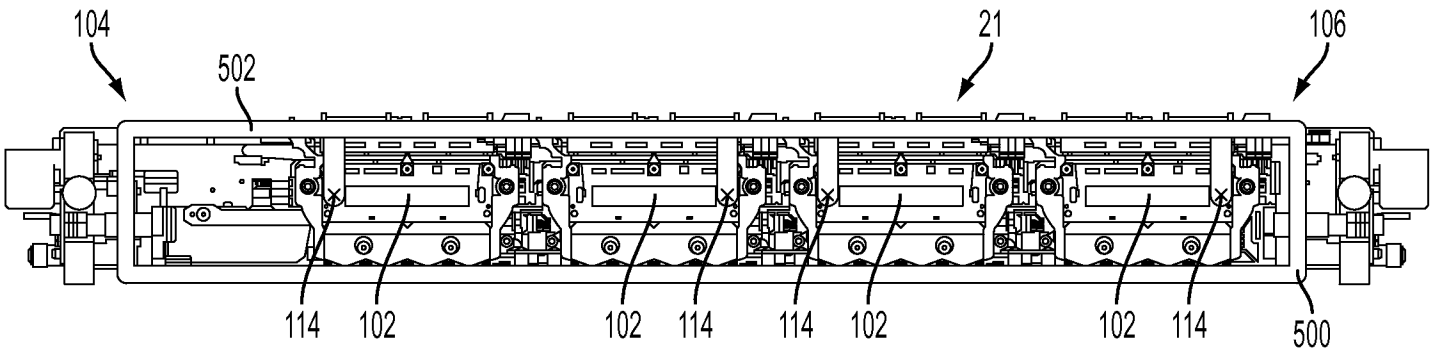
FIG. 4 is a front elevational view of a printhead module including a plurality of printheads and a plurality of sensors mounted to a support.

The printheads 102 are positioned in a linear array extending from the left end 104 (as illustrated in FIG. 4) to a right end 106. Each of the printheads 102 includes an array of nozzles which extend across the face of each of the printheads. Each of the printheads is positioned along the front of the printhead module 21 such that the orifices of each of the nozzles from the left end 104 to the right end 106 are aligned along a substantially flat plane, which is substantially perpendicular to the process direction. The distance between a leftmost (as illustrated) nozzle of a first printhead at the left end 104 to a rightmost nozzle of a last printhead at the right end 106 defines a portion of a printzone in which ink is deposited on the recording medium moving past the printheads. In another embodiment, the printhead module can include a single printhead having an array of nozzles spanning the entire width of a printhead module. In other embodiments, different numbers of printheads can be mounted in a printhead module.

The controller 50 is operatively coupled to each of the printhead modules as is now described with reference to FIG. 1. A user interface 107 is operatively connected to the controller 50 and provides for operator control of a variety of printer settings and adjustments as described herein. The printheads 102 each include a front face 108 having a surface including the array of nozzles. The nozzles on the surface 108 of the printheads 102 are positioned adjacently to the respective backing member 24 and in particular are substantially aligned along the linear direction of a roller 110, also known as a backing roller, included as part of the backing member 24. The roller 110 extends along the line of nozzle arrays and typically includes a length longer than the widest width of recording media being imaged by the printer. The rollers 110 include a metal surface either laminated to or deposited on a roller made of another material or made entirely of the same metal as the metal surface. Each of the rollers 110 is supported for rotation about an axis of rotation at a rotation shaft 111. The rollers 110 and the rotation shafts 111 are supported by a mounting block 109 supported by a frame 202.

The recording media is transported on the rollers in the process direction past each of the printhead modules 21, and in particular between the nozzles of the printheads 102 and the tangent of the rollers 110A and 110B supporting the media. A gap, or space, between each of the surfaces of the rollers and the surface 108 of the printhead 102, is provided to enable the printhead nozzles to eject ink at a location where the recording medium is backed by the roller 110A or 110B. In order to provide acceptable image quality and to prolong the life of the printhead, a printhead to recording media gap distance, or distance between the surface of a printhead and the surface of the recording media, can be selected to be within a certain range of distances to yield an acceptable image quality. For instance, in one embodiment, the gap distance between the surface of the roller 110 and the printhead can vary from approximately 500 microns to 700 microns Depending on the thickness of the media, the gap distance between the printhead and the media can be approximately 50 microns to 230 microns less than the 500 micron to 700 micron distance. While the printhead to recording media gap distance generally falls within a predetermined range of distances, the distance between the surface of the roller 110A or 110B and the surface 108 of the respective printhead can vary over a greater range when printing to different types of recording media. The most important gap distance to set, however, is the gap distance between the printhead and the media.

The thickness, weight, and composition of different types of recording media can vary over a wide range. Heavy card stock is thicker than india paper, for instance, and consequently the selection of the gap distance between the printhead and the roller can be controlled to compensate for the different types of recording media. In addition, due to variations in the production of rollers, printheads, and printhead modules, the gap distance can vary for each printhead module. Not only does accurate control of the gap distance provide improved printing, but damage to printheads resulting from being burnished by the passing recording media can be reduced.

To provide for positioning of the printheads with respect to the rollers, at least one printhead positioner is coupled to at least one of the printhead modules. As illustrated in FIG. 1, a positioner 112A is coupled to printhead module 21A and a positioner 112B is coupled to printhead module 21B. Each of the positioners 112A and 112B receive a signal from the controller 50 that corresponds to the distance between the surface of the rollers 110A and 110B and sensors 114. A positioner, as described herein, can include one or more moving or drive mechanisms to move the printheads and/or printhead modules with respect to the frame. For instance, a single motor can be operatively connected to the printhead module through a ball screw and a nut. In another embodiment, a first motor and a second motor can be coupled respectively to first and second ends of the printhead module to move the module.

Each sensor 114 can be coupled directly to a sensor support, specifically provided and attached to, for instance, a frame 117 of the printhead module 21. The sensors 114 can also be coupled directly to the frame 117 of the printhead module 21 or at the face 108 of the printheads 102. The sensors are accurately positioned with respect to the printhead surface and also with respect to a target such as the surface of the roller 110. The target can also include the mounting block 109 or another feature provided on the frame. In one embodiment, the sensors 114 are capacitor sensors, which can be used to sense the distance between a sensor and an opposing conductive surface, which in the described embodiment is the surface of the roller 110. Other embodiments of the sensor that can be used include an eddy current sensor, a laser sensor, or an optical sensor. While different types of sensors can be used, each sensor needs to be accurately fixed with respect to the printhead surface 108 so that an accurate and repeatable gap setting can be maintained.

The sensors 114 generate an electrical signal representative of the gap distance between the roller, or other target, opposing the sensor and the imaging surface of the printhead 108. This signal is transmitted to the controller 50 over wires (not shown) or wirelessly. If a capacitor sensor is used, the gap distance can be measured directly at an end of the roller where the roller is not covered with paper. The capacitor sensor can also measure a gap distance to the surface of the roller even if the roller surface is covered by recording media since the electric field detected by the capacitor sensor can penetrate the media. This type of sensor, as well as an eddy current sensor, can be particularly useful where gap distances are being measured at locations where the rollers are typically covered with the media. For some types of media, the penetration of the sensor through the media can be affected. Under those conditions, a compensation factor can be used when taking sensor readings to provide repeatable and accurate sensor readings. The compensation factor can be based on the type of sensor and the type of media being imaged and taking into account the placement of the media on the rollers to determine whether the media is located between a sensor and the adjacent surface.

The transmitted sensor signal is then compared to a predetermined gap value stored in a memory of, or associated with, the controller 50. Multiple gap values can be stored in memory to establish different gap distances including values based on the type of media, the type of imaging being performed, including simplex or duplex printing, and taking into account ink buildup on the media. The comparison can be performed by the controller 50 or by a comparator operated by the controller 50. The controller 50 then generates with reference to the difference between a sensor signal and the predetermined gap value an adjustment signal that is sent to the respective positioner 112 for adjustment of the gap distance. By providing a mechanism to automatically adjust the gap distance, the amount of time required for adjustment can be reduced. Fatigue experienced by maintenance personnel can also be reduced. The use of two or more sensors 114, spaced appropriately along the length of the printhead module 21 can be used to sense gap distances simultaneously.

An operator, such as a printer user or maintenance person, can also input a desired gap distance based on the type of recording media being transported through the printer. A user operating the user interface 107 can provide commands or inputs to adjust the gap distance accordingly. A desired gap distance based on the known type of recording media can be used to initially set the gap distance when the recording media is changed from one type to another. Upon receipt of the initial gap signal from the user interface 107, the controller 50 transmits a signal to a positioner 112 to move a respective printhead module 21 along a line 118 either toward or away from the adjacent roller 110. Additional fine tuning of the gap distance can occur once the sensors 114 provide a sensed gap distance and the controller directs the positioner 112 corresponding to a sensor to make the appropriate adjustment. The combination of the sensors and controller provide an open loop controller for adjusting the gap. In another embodiment, a closed loop controller can be used.

Each of the printhead modules 21 is operatively connected to a respective guide 120, which is adapted to direct movement of the printhead module along a predetermined path. The guide 120 includes a shelf 122 which extends substantially perpendicularly from the side of the frame 117. One or more roller supports 124 are operatively connected to a printhead module frame 200 (See FIG. 2) and these supports engage the shelf or ledge 122 connected to a printhead module to enable the printhead module to slide toward or away from the rollers 110. A printhead module roller 126, coupled to the printhead module 21, contacts a corresponding bracket coupled the frame 200. The roller supports 124 and printhead module rollers 126 can include roller bearings, cylinder bearings, or stationary reduced friction mounts to enable movement of a printhead module 21 along one of the linear directions 118A and 118B.

Figure 2:
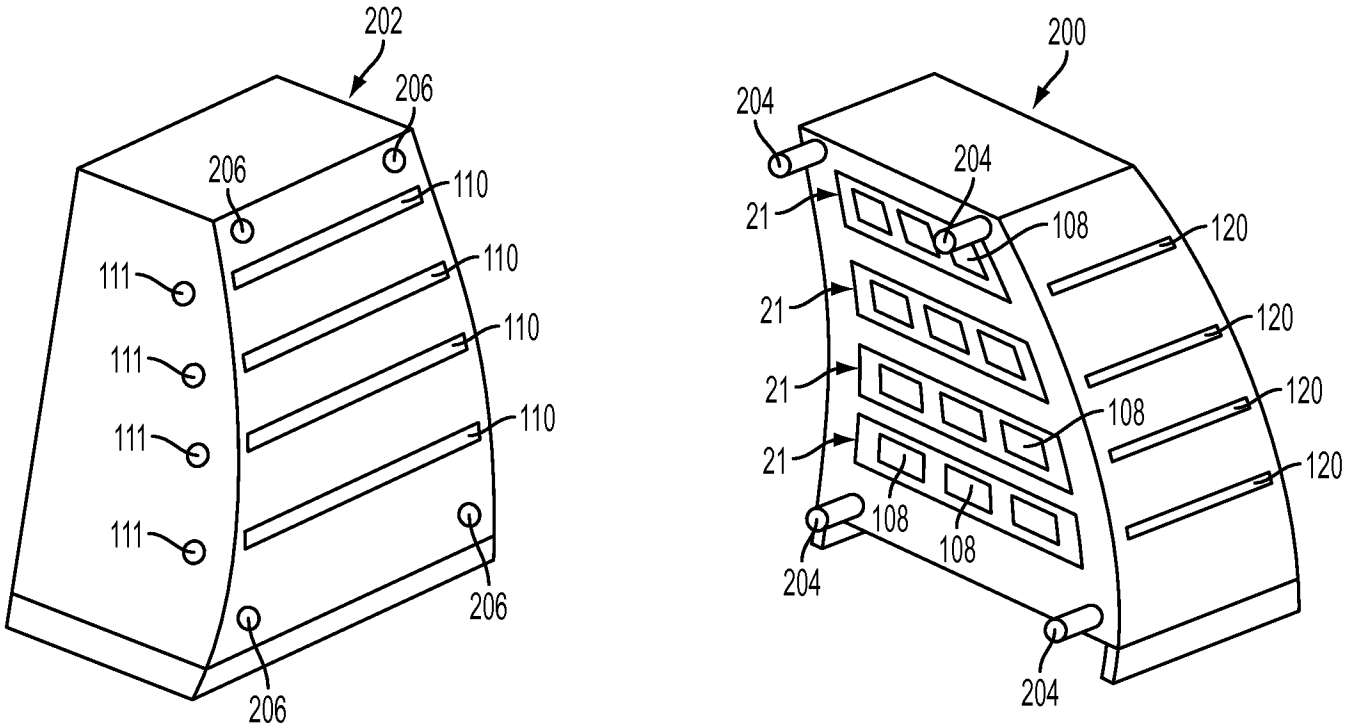
FIG. 2 is a perspective view of a printhead module frame and a backing member frame displaced at ninety degrees for purposes of illustration.

FIG. 2 is a perspective view of a printhead module frame 200 and a backing member frame 202 positioned at ninety degrees with respect to one another for the purpose of illustration. The printhead module frame 200 supports a plurality of printhead modules 21, each of which includes the plurality of printhead surfaces 108. The printhead modules 21 are mounted to the frame 200 with the guides 120. The printhead surfaces 108 interface a corresponding surface of a roller 110, each of which rotate about the axial centerline 111 of the rollers 110 supported by roller bearings mounted in the backing member frame 202.

While the printhead module frame 200 and the backing member frame 202 are illustrated at ninety degrees to illustrate the relative positioning of the rollers 110 and printhead surfaces 108, during printing the frame 200 and frame 202 are aligned and positioned sufficiently close together such that the web of recording media can be transported between rollers 110 and printhead modules 21 for printing. Before printing can begin, however, the frame 200 and frame 202 are positioned adjacent one another in contacting alignment provided by a plurality of first alignment members 204 located on frame 200 and a plurality of second alignment members 206 located on frame 202. The alignment members provide a hard stop for location of the frame 200 to the frame 202 so that an initial gap located between rollers and the printheads can be set to a substantially consistent and repeatable initial value from one printer to the next. Final adjustment of the gap can then be independently made for each printer and for each printhead module to account for individual characteristics between printers, printhead modules, and recording media. In this embodiment where the alignment members provide for the abutting location of one frame to another, no contact occurs between the printhead modules 102 or any part thereof including the module frame 117 and any portion of the frame 202. In other embodiments, contact can be made between printhead modules and an opposing feature on a backing member frame.

Independent gap adjustment specific to a selected printer is made through activation of the positioner 112 as previously described. Each of the printhead modules 21 can include a positioner 112 to move the printhead module 21 either closer to or further away from the respective roller once the frame 200 and frame 202 have been moved into contacting alignment such that the first alignment members 204 contact or engage the second alignment members 206 at contacting interfaces. The alignment members 204 and 206 can include mating connectors, such as hard stops or male/female connectors, to provide an initial gap distance. The alignment members 204 and 206 can provide for alignment of lateral positioning of the frame 200 to the frame 202 as well as for setting the print gap alignment. In another embodiment, the alignment members 204 and 206 can provide for setting of the gap distance only and lateral positioning can be provided by other alignment members or stops.

Figure 3:
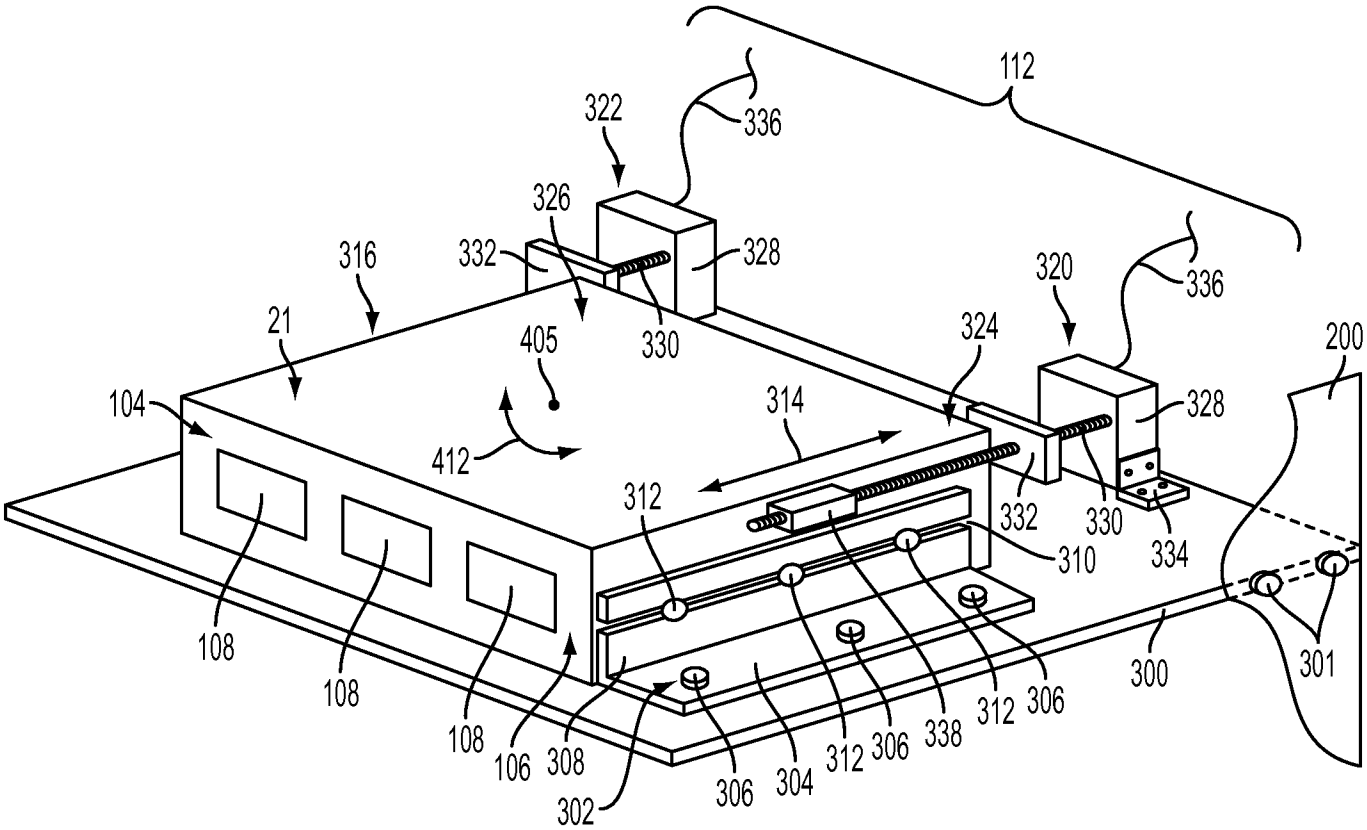
FIG. 3 is a perspective view of a printhead module coupled to a platform.

FIG. 3 illustrates an alternate embodiment showing a perspective view of the printhead module 21 coupled to a shelf 300. The shelf 300 is fixedly coupled to the frame 200 by a plurality of connectors 301, only one of which is shown, such as bolts or screws or other connecting devices. The shelf 300 extends from one side of the frame 200 to the other side of the frame where connectors 301 couple the shelf 300 to the frame 200. In this embodiment, the printhead module 21 is supported for linear movement with respect to the shelf 300 by a bracket 302, which acts as the guide for directional movement of the printhead module 21. The bracket 302 includes a first portion 304 coupled to the shelf by a plurality of fasteners 306. Extending at a substantially right angle from the first portion is a second portion 308 including a slot 310 to enable bidirectional movement of the printhead module 21 with respect to the frame 200. The slot 310 enables movement of the printhead module and accepts a plurality of supports 312. The supports can include roller bearings, cylinder bearings, or stationary reduced friction mounts to enable movement of the printhead module 21 along a linear direction 314 either closer to or further away from a corresponding roller 110. A second bracket (not shown) is located at a side 316 of the printhead module 21.

In this embodiment, the positioner 112 includes a first mover 320 and a second mover 322, each of which is operatively connected, respectively, to rear corners 324 and 326 of the printhead module 21. Each of the movers 320 and 322 includes a motor 328, a ball screw 330, and a nut 332. The motors 328 are fixedly coupled to the shelf 300 by respective brackets 334, only one of which is shown. A cable 336 operatively connects the motor 328 to the controller 50 to enable motor control signals generated by the controller to be sent to the motors 328 in the movers 320 and 322 for position adjustment of the printhead module 21 along the direction 314. The motors can be operated simultaneously or independently of one another.

The nuts 332 are respectively coupled to the printhead module 21 at the corners 324 and 326. Depending on the dimensions of the module 21, the ball screw 330 extends along the respective sides of the module and can have an end held in fixed position at the side by a holder 338. The motor 328 can include any number of AC or DC motors, including stepper motors.

While the embodiment of FIG. 3 has been described having a mover 320 and a mover 322 at each corner of the printhead module 21, other configurations are possible. For instance, a single mover can be used and coupled to the printhead module 21 through an intermediate structure located between the single mover and the printhead module 21 to move the printhead module 21 linearly along the direction 314. The movers 320 and 322 also do not need to include a ball screw and a nut, as other movers can be used such as a lead screw mechanism or a roller screw mechanism.

In another embodiment, the shelf 300 can be eliminated and the printhead module can be mounted to the frame 200 for sliding movement. In this embodiment, the frame can support the positioner 112 for linear movement of the module and can include a ball screw, nut, and motor mechanism. The motor 328 can be fixedly mounted to the frame 200 with the ball screw 330 extending to the nut 332 coupled to the printhead module 21. In this embodiment and others, different mounting schemes located between the printhead modules and structures for supporting printhead modules or structures for adjusting printhead modules can be used to minimize vibration.

As described above, the printhead module 21 can be moved along the direction 314 to move the printhead module either further away from or closer to the corresponding roller 110. The sensor located at the left end 104 and the sensor located at the right end 106 of the printhead module provide a gap distance reading at each end and can provide a signal to respective movers 320 and 322 to move each of the ends 104 and 106 substantially the same distance. In some situations, however, due to an offset along the face of the entire printhead module, or due to positioning of the printheads along the front of the module, or due to an accumulation of manufacturing tolerances, one of the sides of the nozzle array can be located further away from the roller than the other side. This offset can provide a gap distance which is different at the ends of the printhead module. To minimize or to compensate for this offset, one side of the printhead module can be moved a greater or lesser amount than the other side. When moving one side a distance more or less than the distance moved at the other side, the printhead module 21 is rotated about an axis 405 to move the printhead module 21 along an arc or in a direction 412. (See FIG. 3) If more than two sensors are used, and gap distances are determined at locations other than the left end 104 and the right end 106, the printhead module 21 can be moved to a location to average the non-linearities appearing over the entire front surface of the printhead module. In another embodiment where multiple sensors are provide, the measure gap distances can be recorded and saved in a database for later review. The saved information can be compared to image quality information, including nozzle history, to provide improved image quality.

The guides, including the guide 120 and the bracket 302, can include a structure to provide for rotational movement of the printhead module about the axis 405. In one embodiment, the amount of movement required to correct for printhead module skew is approximately three millimeters. Other types of guides are within the present disclosure to account for other amounts of skew, including the use of a turntable supporting the printhead module for rotation. Generally, however, the guides as described herein include a sufficient amount of play to correct alignment for a measured skew. Because the printhead module 21 can be moved about the direction 412, the nozzles at either end of the nozzle array can be moved in opposite directions to correct for misalignment along the front face 108 of the printhead module 21.

Figure 5:
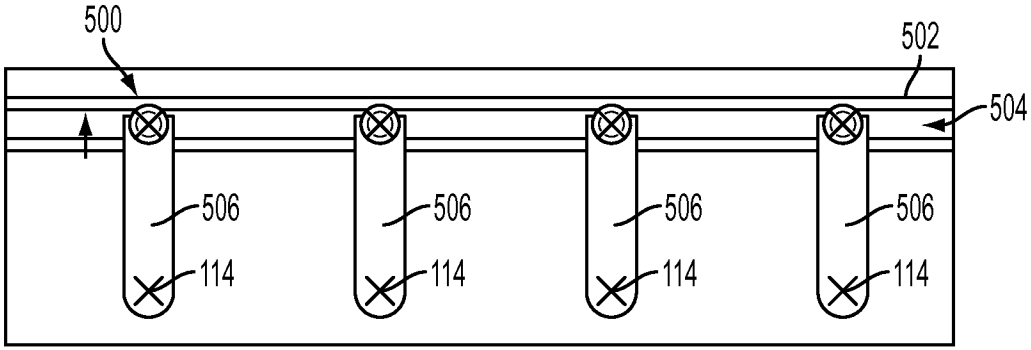
FIG. 5 is a front elevational view of a track portion having a groove to receive one or more locators each being coupled to a sensor.

FIG. 4 is a front elevational view of the printhead module 21 including a plurality of printheads 102 and a plurality of sensors 114 coupled to another embodiment of a sensor support 500. The sensor support 500 provides for a plurality of locations to locate sensors 114 along the length of the nozzle array. As illustrated in FIG. 5, the support 500 includes a track portion 502 having a groove 504 which receives one or more locators 506 each being coupled to one of the sensors 114. The groove 504 slidingly receives a mating portion of the locator 506 to provide for positioning of the sensors. Each of the locators 506 includes a predetermined length to position the sensor 114 vertically (as illustrated) such that the positioned sensor is coincident with the tangent of the roller 110 where the gap distance is generally the smallest.

In FIG. 4, the sensors are located at opposite ends of adjacent printheads. Consequently, the sensors are located at opposite ends of an array of nozzles consisting of adjacent printheads. These positions illustrate measurement locations where a sensor can be located to provide gap distance information. While the measurement locations for each individual printhead can be at either of the ends of an individual nozzle array within a printhead, other locations within a nozzle array can be selected. It is also possible to make a measurement at each of the ends of a nozzle array for each printhead in a printhead module. In such an embodiment, the printhead module 21 of FIG. 5 would have eight sensors. Additional sensors can provide more gap information within a printhead module.

By mounting four sensors 114 on the bracket 500 of FIG. 5, gap distance can be measured along the front faces of the individual printheads. Gap information such as gap skew across the printhead unit as well as gap smile or gap frown can be determined. Gap skew can be adjusted to place each of the ends of the printhead nozzle array at the same distance from the rollers. Gap smile or frown occurs when the nozzles at the center of the nozzle array are either closer to or further away from the surface of the roller than are the ends of the nozzle array.

In the embodiment of FIG. 4, the mounting support 500 is a metal fixture with the track 502 facing the printheads to enable the sensors to be placed anywhere along the horizontal dimension (as illustrated) of the bracket. While the support 500 could be permanently attached to the printhead unit 21 to provide gap distance readings, the support 500 can also be detachable to enable the same support to accommodate different printhead positions and different printhead modules having different numbers of printheads. The support could also be moved to another printer for making gap distance measurements.

While the sensor support 500 can be used to provide additional information related to gap skew and gap smile, additional sensor supports provided in the embodiment of FIG. 1, can also provide gap skew and gap smile measurements as well. For instance, a third sensor could be mounted approximately halfway between the sensor 114 located at the left end 104 and the right end 106. The locations of the sensors 114 of FIG. 1 can provide a repeatable result since the locations of the sensors are relatively fixed while the support 500 which can be adjusted can be used to determine the locations of anomalies along the entire length of the printhead depending on the position of the locators 506.

With the sensors in the desired positions, the controller 50 executes programmed instructions, which can be stored in a memory operatively connected to the controller 50, to obtain the signals generated by the plurality of sensors 114 located along the track 502. The controller also compares the distance information corresponding to the sensor signals to predetermined gap setting limits and, if the measured gap distances fall outside of the specification limits, the out of specification printhead module 21 is identified as requiring adjustment. The controller then transmits a signal to the positioners 112, 320 or 322, to adjust the gap dimensions. Multiple gap distances across a printhead module can be measured simultaneously. The gap distances can also be measured continuously and adjusted as necessary in this and the other embodiments. This method of operation can also be used in the other described embodiments.

Figure 6:
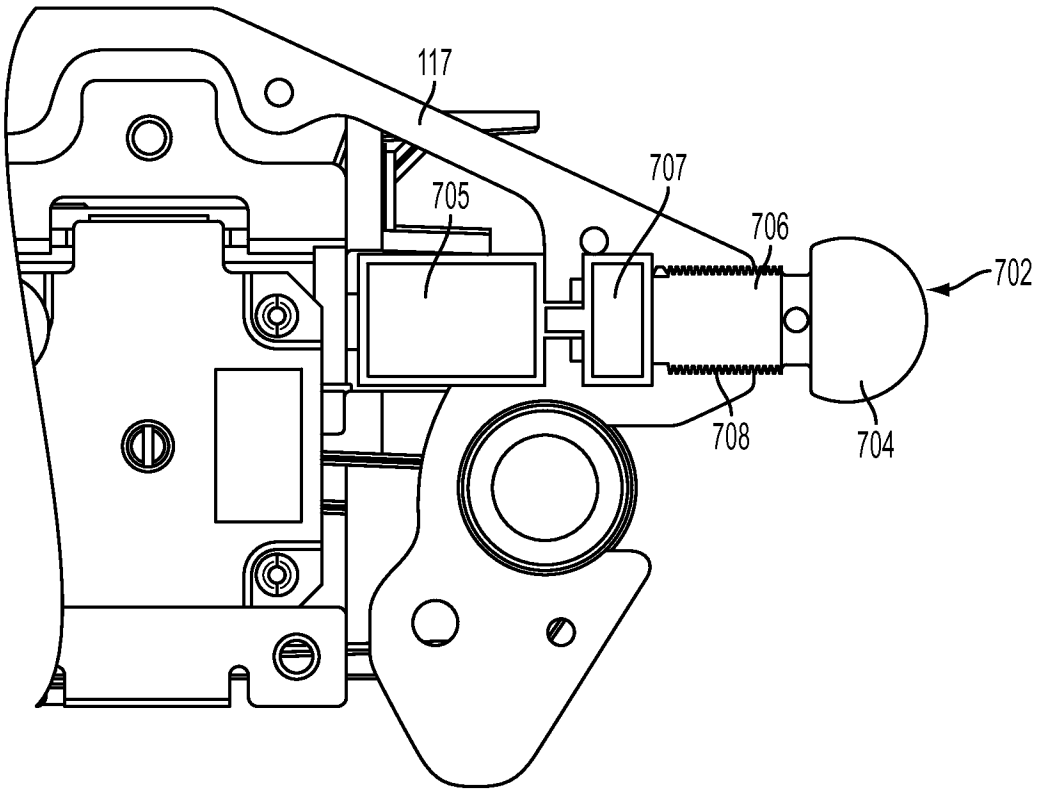
FIG. 6 is a side elevational view of a printhead module frame including a docking sphere coupled to a motor.

FIG. 6 is a side elevational view of a portion of a printhead module 21 including the printhead module frame 117 supporting an extension 702. A second extension 702 can be mounted at an opposite side of the printhead module. The extension 702, illustrated as a docking sphere, includes a first portion 704 coupled to a threaded shaft 706. The frame 117 includes a threaded aperture 708 adapted to rotatably receive the threaded shaft 706. The first portion 704 of the docking sphere 702 can include a spherically shaped surface, which is adapted to contact a receiving portion (not shown) at the frame 202. Upon engagement of the frame 202 to the frame 200, contact of docking sphere 702 to the receiving portion provides for an initial location of the printhead module 21 along the guide. To facilitate the initial location of the printhead module 21, the extension 702 or the printhead module 21 can be spring mounted to provide for an initial adjustment during contact with the associated frame.

A motor 705 is coupled by a coupler 707 to the shaft 706 and operatively connected to the controller 50 to enable the controller 50 to operate the motor and rotate the shaft within the aperture 708. In response to rotational movement of the shaft 706, the docking sphere 702 moves into or out of the aperture 708. The printhead module 21, in turn, is positioned either further away from or closer to the adjacent roller. The motor 705 can be a stepper motor so rotation of the motor shaft rotates the docking sphere 702.

In this embodiment, positioning of the docking spheres 702 adjusts the gap between the printhead module and the adjacent roller. The signal information received from the controller 50 is used to adjust the gap distance until the measured gap distance falls within the specification limits. The docking spheres can be manually adjusted, if no motor is connected to the threaded shaft, by rotating the docking spheres by hand. A different type of manual adjustment can occur when a motor is included and adjusted through the user interface 107. In this case, the measured gap distance could be displayed at the user interface 107. Adjustments to the gap distance could then be made by manually controlling the rotation of the motor at the user interface.

By using the measured gap and knowing the pitch of the aperture threads, the controller 50 can calculate the amount of docking sphere rotation required to eliminate the difference between the measured gap distance and a target gap distance. Two motors can be used per printer module 21 to drive each docking sphere 702 independently. The controller 50 would use component control, if manually driven, to drive the appropriate motor(s) until the measured gap distance falls within the specification limits. A holding current, if required, can be applied to the motors whenever the machine is powered up and running such that the gap would not change inadvertently. The adjustment to the gap distance can be automatic when the controller 50 includes the appropriate algorithmic control. Adjustment can also be provided by a user or operator providing adjustment information through the user interface to the controller 50.

In another embodiment, sensors permanently attached to the printhead module, for instance as described for FIG. 1, could measure the gap distance continuously. Each sensor, in this embodiment, generates a signal corresponding to a distance measurement and, if the measured distance falls outside of the specification range, a command is sent to stepper motors 705 coupled to each of the docking spheres. Separate commands are sent to each motor such that the docking spheres could be rotated independently in the appropriate direction in an amount until the measured distance is within the specification limits. In this embodiment, automatic adjustment of the gap distance can be made using the stepper motor coupled to the docking spheres.

Sensors can make a measurement before a printhead module is positioned initially and can be made each time after the gap distance has been adjusted. Gap distance information can be collected and stored by the controller for each of the printhead modules over a period of time and used for machine improvement and machine problem investigations. Continuous monitoring and collection of gap distance information can be compared to other collected printer information, such as image quality, and used for not only improving image quality of an individual printer, but used for product improvement across a line of printers.

It will be appreciated that several of the above-disclosed and other features, and functions, or alternatives thereof, can be desirably combined into many other different systems or applications. Various presently unforeseen or unanticipated alternatives, modifications, variations, or improvements therein can be subsequently made by those skilled in the art, which are also intended to be encompassed by the following claims.

What is claimed is:

1. A printer comprising:

a media transport, mounted to a first frame, configured to transport a recording media through the printer in a process direction;

a printhead module, operatively connected to a second frame and disposed adjacent to the media transport, the printhead module supporting a plurality of printheads configured to print onto the transported recording media;

at least one positioner operatively connected to the printhead module to adjust a gap distance between the printhead module and the media transport;

a first sensor mounted at a first end of the printhead module, the first sensor being configured to generate a first signal representative of a first gap distance at the first end;

a second sensor mounted at a second end of the printhead module, and the second sensor being configured to generate a second signal representative of a second gap distance at the second end;

a controller operatively connected to the first sensor, the second sensor, and to the at least one positioner, to receive the first signal generated by the first sensor and the second signal generated by the second sensor, and to send an adjust signal to the at least one positioner to move the printhead module with respect to the media transport; and a first guide and a second guide, the first and the second guides being operatively connected to the first side and the second side of the printhead module, respectively, to enable linear movement of the printhead module along a predetermined path in response to the at least one positioner adjusting the first gap distance and the second gap distance.

2. The printer of claim 1 wherein the at least one positioner includes a first positioner operatively connected to the first side of the printhead module and a second positioner operatively connected to the second side of the printhead module, wherein the first and second positioners respectively respond to the first and second signals to adjust the first gap distance and the second gap distance.

3. The printer of claim 2 wherein the first and second guides are configured to provide for movement of the printhead module about an axis to such that the first gap distance can be adjusted differently than the second gap distance.

4. The printer of claim 3 further including a memory to store a first gap distance value and a second gap distance value and a comparator to generate the first signal in response to a comparison of the first gap distance value to the first signal and to generate the second signal in response to a comparison of the second gap distance value to the second signal.

5. The printer of claim 4 wherein the first frame includes a first alignment member positioned on the first frame at a preselected location and the second frame includes a second alignment member positioned on the second frame at a preselected location such that placement of the first frame in contact with the second frame provides a contacting interface between the first alignment member and the second alignment member to provide a repeatable positioning of the first frame to the second frame for printing the recording media.

6. The printer of claim 5 wherein at least one of the first sensor and the second sensor is a contact sensor.

7. The printer of claim 5 wherein at least one of the first sensor and the second sensor is a non-contact sensor.

8. The printer of claim 7 wherein the non-contact sensor includes at least one of an eddy current sensor, a laser sensor, or an optical sensor.

9. The printer of claim 5 further comprising a user interface operatively connected to the controller to enable a user to adjust at least one of the first gap distance and the second gap distance.

10. The printer of claim 5 wherein the positioner comprises an electrical motor, a ball screw, and a nut.

11. The printer of claim 10 wherein the ball screw and motor are operatively connected to the second frame and the nut is operatively connected to the printhead module.

12. The printer of claim 10 further comprising a shelf upon which the printhead module is mounted and the motor is operatively connected to the shelf.

13. A printer comprising:

a media transport, mounted to a first frame, configured to transport a recording media through the printer in a process direction;

a printhead module that includes a module frame, the printhead module being operatively connected to a second frame and disposed adjacent to the media transport, the printhead module supporting a plurality of printheads configured to print onto the transported recording media;

at least one positioner that is operatively connected to and extends from the module frame to contact the first frame to define a gap distance between the printhead module and the media transport, the at least one positioner having a docking sphere operatively connected to a motor to enable the motor to move the docking sphere closer to or away from the module frame to adjust the gap distance;

at least one sensor, operatively connected to the printhead module, to sense the gap distance and to generate a signal representative of the gap distance;

a controller operatively connected to the sensor and to the at least one positioner, to receive the signal and to send an adjust signal to the at least one positioner to move the printhead module with respect to the media transport;

a guide operatively connected to the printhead module, wherein the guide directs movement of the printhead module along a predetermined path in response to the at least one positioner adjusting the gap distance between the printhead module and the media transport.

14. A printer comprising:

a media transport configured to transport a recording media through the printer in a process direction;

a printhead module disposed adjacent the media transport, the printhead module supporting a plurality of printheads configured to print onto the transported recording media;

a first sensor mounted at a first side of the printhead module, the first sensor being configured to generate a first signal representative of a first gap distance at the first side;

a second sensor mounted at a second side of the printhead module, the second sensor being configured to generate a second signal representative of a second gap distance at the second side;

a positioner, operatively connected to the printhead module and adapted to receive the signal, to move the printhead module with respect to the media transport to adjust the first gap distance and the second gap distance;

a guide operatively connected to the printhead module, the guide being configured to direct movement of the printhead module along a predetermined path in response to the positioner adjusting the first gap distance and the second gap distance between the printhead module and the media transport and the guide is configured to provide pivoting movement of the printhead module about a pivot axis to adjust the first gap distance to be different than the second gap distance.

* * * * *